US005871433A

United States Patent [19]

Lehmann et al.

[11] Patent Number: 5,871,433

[45] Date of Patent: Feb. 16, 1999

[54] BUCKLE FOLDING MACHINE WITH A COLLECTING FOLDING POCKET

[75] Inventors: Werner Lehmann, Gutach; Wilhelm Markgraf, Tennenbronn, both of Germany

[73] Assignee: Mathias Bäuerle GmbH, St. Georgen/Schw., Germany

[21] Appl. No.: 728,776

[22] Filed: Oct. 11, 1996

[30] Foreign Application Priority Data

Oct. 13, 1995 [DE] Germany ..... 295 16 265 U

[51] Int. Cl.[6] ..... B31F 1/00

[52] U.S. Cl. ..... 493/420; 493/23; 493/28; 493/421; 271/196; 270/32

[58] Field of Search ..... 493/10, 23, 28, 493/29, 418, 419, 420, 421, 450; 271/196; 270/37, 39, 7, 58.24, 58.07, 58.11, 58.01

[56] References Cited

U.S. PATENT DOCUMENTS

| | | | |
|---|---|---|---|
| 4,440,388 | 4/1984 | Divoux | 271/196 |
| 4,466,605 | 8/1984 | Leuthold | 271/196 |
| 4,621,966 | 11/1986 | Luperti et al. . | |
| 4,662,622 | 5/1987 | Wimmer | 271/196 |
| 4,898,570 | 2/1990 | Luperti | 493/420 |
| 4,976,419 | 12/1990 | Bartoes | 270/45 |
| 5,095,682 | 3/1992 | Steidinger | 493/216 |
| 5,183,246 | 2/1993 | Edwards | 270/45 |
| 5,183,252 | 2/1993 | Wolber | 271/276 |
| 5,269,744 | 12/1993 | Moll . | |
| 5,441,244 | 8/1995 | Bartoes | 270/45 |
| 5,514,066 | 5/1996 | Monaco | 493/25 |
| 5,564,684 | 10/1996 | Salancy | 493/421 |

FOREIGN PATENT DOCUMENTS

| | | |
|---|---|---|
| 38 30 754 A1 | 3/1989 | Germany . |
| 94 04 431 U | 6/1994 | Germany . |
| 41 14 105 C2 | 9/1994 | Germany . |

*Primary Examiner*—Joseph J. Hail, III
*Assistant Examiner*—Christopher W. Day
*Attorney, Agent, or Firm*—McGlew and Tuttle

[57] ABSTRACT

Buckle folding machine including folding pockets, which have a paper stop each. One folding pocket being for collection and subsequent joint folding of a plurality of sheets. From the folding pocket the collected sheets of paper pass together through a folding mechanism, having a draw-in point formed by upper and lower draw-in rollers and having at least one pair of folding rollers forming a folding point. A sheet feeder with a conveyor track directed toward the draw-in point, in which a stacking ramp is located, is arranged in front of the draw-in point. To guarantee trouble-free operation even when the intake depth is smaller than the greatest sheet size, an additional sheet drive, which partially conveys the newly arriving sheet through the draw-in point into a collecting folding pocket arranged behind it in a position in which it is lifted off from the conveyor track or from the sheets deposited in the conveyor track behind the stacking ramp, is arranged between the draw-in point, which is provided with an open passage gap, and the stacking ramp at a vertically spaced location above the conveyor track.

20 Claims, 5 Drawing Sheets

BUCKLE FOLDING MACHINE WITH A COLLECTING FOLDING POCKET

FIELD OF THE INVENTION

The present invention pertains to a buckle folding machine with one or more folding pockets, each of which is provided with a paper stop. One folding pocket is equipped for collecting and the subsequent joint folding of a plurality of sheets of paper. From there the collected sheets of paper pass together through the folding mechanism, which has a draw-in point formed by an upper draw-in roller and a lower draw-in roller and at least one pair of folding rollers forming a folding point. Wherein a sheet feed means with a conveyor track directed toward the draw-in point, in which conveyor track a stacking ramp is located, is arranged in front of the draw-in point.

BACKGROUND OF THE INVENTION

A device for collecting and jointly folding a plurality of sheets of paper of unequal length by means of a collection station has been known (DE Utility Model No. G 94 04 431.7), in which the sheets of paper collected in the collecting station pass together through a buckle folding mechanism, which has at least one folding pocket with a paper stop equipped for performing lifting movements and is provided with at least one paper deflector arranged in front of another folding pocket.

The collecting station is provided with an electromagnetically controllable sheet-stopping means, which is arranged in a sheet conveyor track directed toward the draw-in point of the buckle folding mechanism. Between a plurality of conveying strands of endlessly running conveyor belts located above and under the sheet conveying track, the sheet conveyor track has a stacking ramp, by which the arriving sheets are placed one on top of another in front of the sheet-stopping means. Only one folding pocket is open and active in the buckle folding mechanism; the paper stop of this folding pocket is set to an intake depth corresponding to half the size length of the long sheet of paper, and is mounted elastically movably between two fixed end positions in the draw-in direction.

Long and short sheets of paper can be transported together through a buckle folding mechanism with this prior-art device, and they can be folded in the process such that one or more short sheets of paper are folded together into the long sheet of paper without being folded itself or themselves, in order to be subsequently stuffed into an envelope in an envelope-stuffing device, or to be sealed. The long sheets of paper may be introduced into the collecting station optionally before or after the short sheets of paper. The folding of these sheets of paper around the short sheet of paper running together with it may be optionally performed in the first or second folding pocket or folding point. This requires only a different programming of the electronic control device, which is commonly used in such plants anyway.

This device is unsuitable for collecting and folding in packets of a plurality of sheets of paper of equal length because the folding pocket located behind the draw-in point must be set to an intake depth that corresponds to the size length of the short sheets of paper, and a folding takes place each time a long sheet of paper is drawn in. The collection of the sheets of paper is also not performed with this device in a folding pocket, but in a collecting station, which is arranged upstream of the folding mechanism or its draw-in point, and which must have a sheet-stopping device of its own and requires a corresponding space.

A buckle folding machine with a plurality of pairs of folding rollers forming a folding point each has also been known (DE-A-41 14 105), which has a plurality of folding pockets associated with the individual folding points, and which folding pockets are provided with a paper stop each, which can be adjusted with its stop surface to stop planes which determine different lead lengths for the arriving material to be folded. To make it possible to use this buckle folding machine both as a conventional folding machine for folding individual sheets of paper running through and for collecting and jointly folding a plurality of sheets of paper, a folding pocket designed for simultaneously receiving a plurality of sheets of paper is arranged and designed such that the individual sheets of paper can run automatically up to the paper stop over their entire length and remain there. In addition, this folding pocket has a pushing means, which performs pulsed lifting movements by means of a special drive controlled by a presettable sheet-counting means or code-reading means, and the sheets of paper collected in that folding pocket are conveyed together into the next folding point by the pulsed lifting movements.

Since the collection of a plurality of sheets of paper takes place here in a folding pocket that is sloped downward in the intake direction for this purpose and is equipped with an ejector, satisfactory operation requires that all the collected sheets of paper have at least approximately the same length and that the intake depth be set to that length, so that a slight push is sufficient to push the sheets of paper collected in that folding pocket with their front edges facing the next folding point into that folding point, so that they will be grasped and further conveyed there. However, folding of the paper does not take place in this folding point. The folding can then be performed only by means of a subsequent folding pocket and subsequent additional folding points.

This device is unsuitable for jointly folding sheets of paper of unequal length. In addition, the first folding pocket, i.e., the folding pocket arranged directly behind the draw-in point, cannot be used as a collecting folding pocket in prior-art buckle folding machines, because this folding pocket rises in the intake direction, and the arriving sheets of paper would fall out immediately.

In another prior-art buckle folding machine (DE 3 830 754), the conveyor belts of a conveying means, which is arranged in front of the draw-in point formed by two draw-in rollers and is provided with a stacking ramp, are driven at a higher conveying speed than the two draw-in rollers in order to obtain the highest possible degree of overlap of the sheets of paper reaching the stacking ramp one after another. The sheets of paper arriving in the folding pocket, which is arranged directly behind the draw-in point with a residual offset, are thus not folded simultaneously, but staggered in time and offset in space in relation to one another in a folding point through which they pass vertically downwardly directed in order to be subsequently pushed automatically into one another in an approximately vertical position.

Aside from the fact that multiple folds cannot be made according to this method, the phenomenon of electrostatic charging, which highly compromises function, proved to be very disturbing in practice. The conveying and consequently the degree of overlap of the individual sheets of paper become uncontrollable due to the electrostatic charge of the individual sheets of paper, which is caused essentially by the sheets of paper sliding one on top of another with a friction. The sheets of paper stick together in the case of different overlaps, so that not all of them reach the stop in the folding pocket, and a completely uncontrollable folding is obtained. Consequently, this device is not reliable in operation.

SUMMARY AND OBJECTS OF THE INVENTION

The basic object of the present invention is to design a device of the class described in the introduction with simple means such that sheets of paper arriving one after another in its folding pocket directly following the draw-in point and in the area of the draw-in point are collected in a trouble-free manner and can be subsequently conveyed together through the buckle folding mechanism and can be optionally folded several times, even if the intake depth set in this folding pocket is substantially shorter than the size length of the individual sheets of paper measured in the intake direction.

This object is accomplished according to the present invention in that an additional sheet drive, which partially conveys the newly arriving sheet through the draw-in point into the collecting folding pocket arranged behind it in a position in which it is lifted off from the conveying track or from the sheets deposited in the conveying track behind the stacking ramp, is arranged between the draw-in point provided with an open passage gap and the stacking ramp at a vertically spaced location above the conveyor track.

The special advantages of the present invention are that sheets with different size lengths can be processed, and that the friction between the actually arriving and already collected sheets of paper, which generates electrostatic charge, is reduced to a minimum.

One embodiment of the additional sheet drive uses a suction roll and gives the special advantage that such a sheet drive has been successfully used in practice for many years in sheet-decollating devices and it guarantees trouble-free operation at high speeds of operation. The intensity of the suction is controllable to optimized in terms of the nature of the material to be processed by folding.

The vertical distance between a jacket surface of the suction roll and the conveyor track is a most equal to the amount by which the stacking ramp projects over the conveyor track. The suction roll also includes means for uniformly rotating the suction roll at a circumferential speed corresponding to a conveying speed of the sheet feed means and the circumferential speed is at most equal to a circumferential speed of the folding rollers. These two embodiments contribute to an increase in the reliability of operation.

It is be possible, in principle, to continuously drive the upper draw-in roller and to move it, to initiate a folding process, from a lift-off position into a lowered position, in which it can grasp the collected sheets of paper in cooperation with the lower draw-in roller arranged under it and it can feed them to the first folding point, forming a fold loop. It is also possible to have the suction roll includes means for uniformly rotating the suction roll at a circumferential speed corresponding to a conveying speed of the sheet feed means and where the circumferential speed is at most equal to a circumferential speed of the folding rollers. This embodiment offers the advantage that it can be embodied in a substantially simpler manner, at a lower cost, and also in such a way that its reliability of operation will be high at a high speed of operation.

The upper draw-in roller can form the passage gap and is driven from a resting position for one revolution synchronously with the folding rollers (W1, W2, W3) in terms of its circumferential speed by means of a remotely controllable one-stop clutch. Also the passage gap of the draw-in point can be formed by a circumferential section of the upper draw-in roller, with the circumferential section being flattened in a segment-like manner. These embodiments contribute to the simplification and to achieving a high reliability of operation at a high speed of operation.

The stacking ramp means can include means for positioning the stacking ramp at different distances from the draw-in point. This embodiment is advantageous because it offers the possibility of adjusting the distance between the stacking ramp and the paper stop of the collecting folding pocket to different size lengths or to different types of fold.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
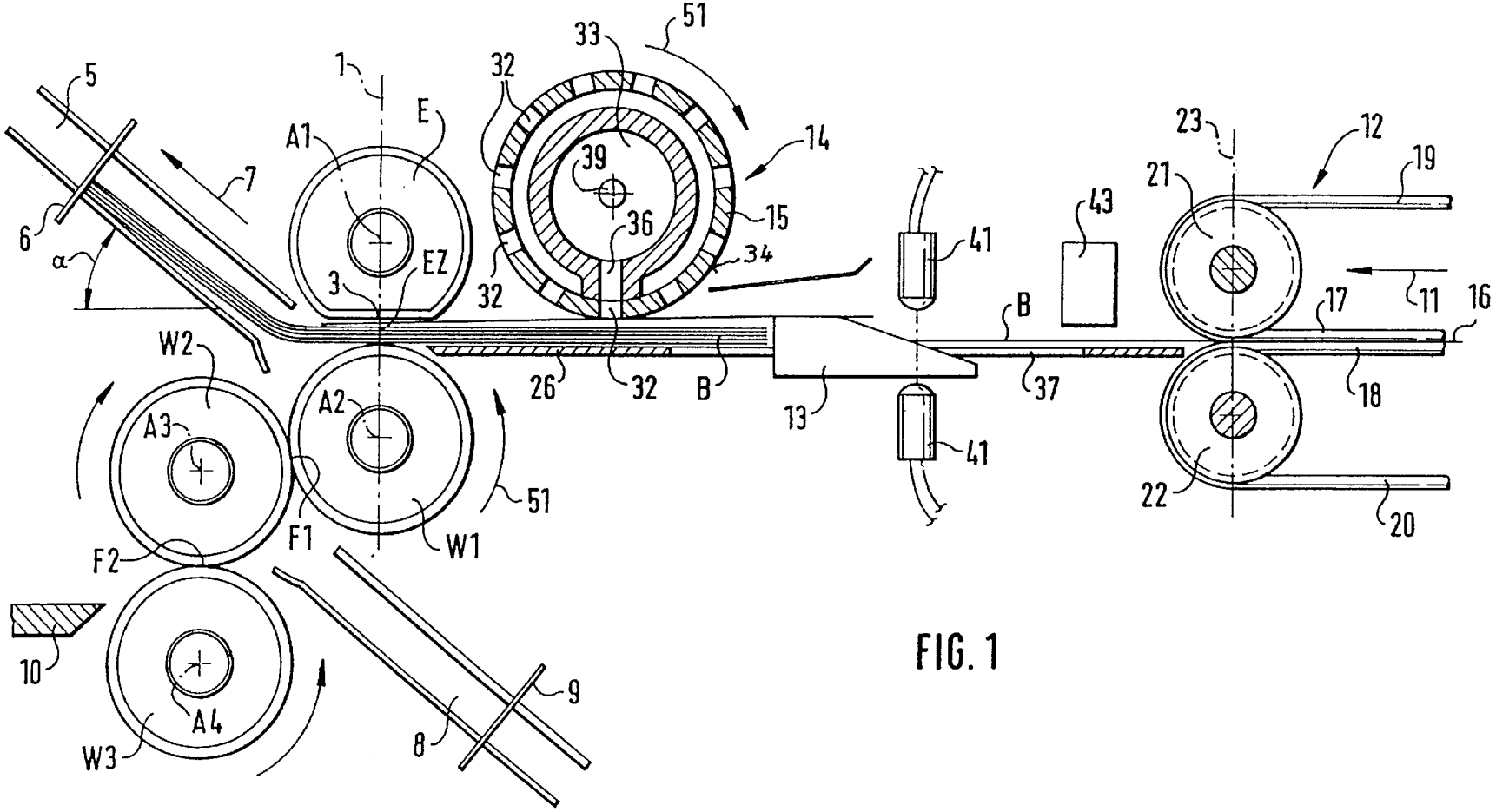
FIG. 1 is a schematic side view of a buckle folding machine with a collecting folding pocket for collecting and folding a plurality of sheets of paper, and with a feed means.

The buckle folding machine shown schematically in FIGS. 1 through 3 and 5 has three folding rollers W1, W2, and W3, which are arranged in the usual manner and form two folding points F1 and F2. An upper draw-in roller E is arranged above and in the same vertical plane 1 as the folding roller W1. The axis A1 of this upper draw-in roller E extends in parallel to the axis A2 of the folding roller W1 and also in parallel to the respective axes A3 and A4 of the other folding rollers W2 and W3. The folding roller W2 is also used at the same time as a lower draw-in roller, which temporarily cooperates with the upper draw-in roller E. The upper draw-in roller E preferably has the same external diameter as the folding rollers W1, W2, and W3. However, it is provided with a circumferential section 3 flattened in a segment-like manner, and it is driven synchronously with the folding rollers W1 through W3 only intermittently and always for one full revolution, via a one-stop clutch 2 shown in FIG. 6, rather than continuously, which means that it has the same circumferential speed as the folding rollers W1, W2, W3. In the resting position of the upper draw-in roller E, the flattened circumferential section 3 of the upper draw-in roller E assumes the position shown in FIGS. 1 and 2, in which the upper draw-in roller forms an open passage gap 4 with the jacket surface of the folding roller W1 and the lower draw-in roller, and the height h of this passage gap is about 4–5 mm if standard writing paper or sheets of a similar quality are processed with this folding machine. The draw-in point EZ formed by the upper draw-in roller E and the folding roller W1, or the lower draw-in roller arranged under it, has the open passage gap 4 in the resting position of the upper draw-in roller E1.

Figure 3:
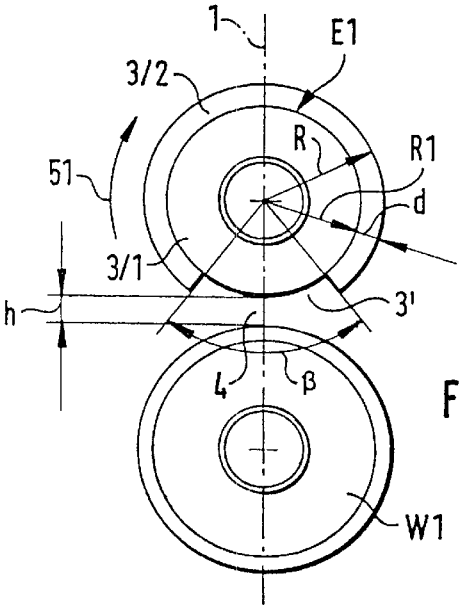
FIG. 3 is a schematic side view of another embodiment of the upper draw-in roller.

In the embodiment shown in FIG. 3, the passage gap 4 of the draw-in point EZ is formed by a circumferential section 3' of the upper draw-in roller E1, which section has a radius R1 reduced by the gap width h. The draw-in roller consists of a cylindrical core 3/1 having the radius R1 and an elastic jacket 3/2, whose thickness d corresponds to the gap width h. The tapered circumferential section 3' is thus formed by an interruption of the jacket 3/2, which extends over an angle β of about 80°–90°.

A collecting folding pocket 5 of the usual design with an adjustable paper stop 6 is located directly behind this draw-in point EZ or behind the passage gap 4. This collecting folding pocket 5 has an oblique position rising by an angle α of about 35° in the intake direction indicated by arrow 7. A second folding pocket 8, which also has an adjustable paper stop 9 is used to receive the folded material arriving from the folding point F1, and is arranged in the usual manner under the first folding roller W1. The folded material is then conveyed from this folding pocket 8 through the folding point F2 and out of the buckle folding machine onto a delivery table 10.

Adjustable paper deflectors, which are necessary for performing certain types of folding, may also be arranged in front of the folding pockets in the usual manner.

The paper is fed into the passage gap 4 in the direction of the arrow 11 from a sheet feed means 12 via a stacking ramp 13 and by means of an additional sheet drive 14. This additional sheet drive 14 is arranged in the form of a rotatingly driven suction roll 15 between the stacking ramp 13 and the draw-in point EZ formed by the passage gap 4. An essentially horizontal conveyor track 16, which is directed toward the draw-in point EZ and in which the lower and upper strands 17 and 18 of respective endless conveyor belts 19 and 20 extend, is defined by the sheet feed means 12. The conveyor belts are guided around drive wheels and deflecting disks 21, 22 and are continuously driven at a conveying speed that approximately corresponds to the circumferential speed of the likely continuously running folding rollers W1 through W3. These drive wheels and deflecting disks 21, 22 are attached to respective shafts 24 and 25 arranged one on top of another in a common vertical plane 23.

A horizontal draw-in paper guide 26, whose top side lies in the same plane as the conveyor track 16, is arranged between the drive wheel and deflecting disks 21, 22 and the draw-in point or the passage gap 4.

The stacking ramp 13 comprises two wedge-shaped blocks 28 and 29, which are arranged symmetrically to a longitudinal central axis 27 (FIG. 6) of the overall arrangement and have a lifting surface 30 each, which obliquely rises in the direction of conveying and ends in a common horizontal plane 31. This horizontal plane 31 is located at a vertical distance b above the conveyor track 16 or above the upper guide surface of the paper guide 26. This vertical distance b is preferably somewhat greater than the height h of the passage gap 4.

Figure 2:
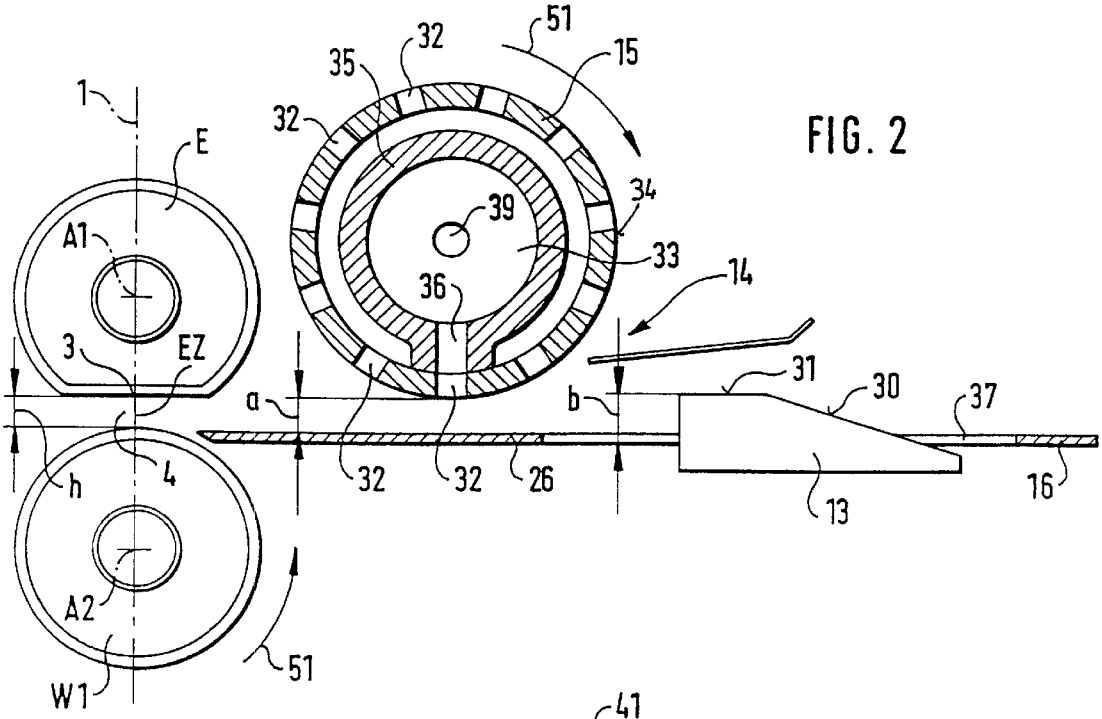
FIG. 2 is an enlarged detail from FIG. 1.
Figure 5:
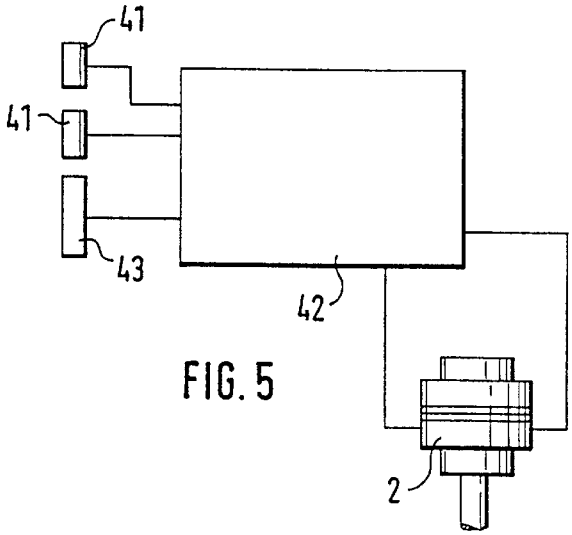
FIG. 5 is a simplified block diagram of an electronic control device.

As is apparent from FIGS. 1 and 2, the paper guide 26 has slots 37, within which the blocks 28 and 29 forming the stacking ramp 13 are adjustable in their horizontal plane in the direction of conveying and can be adjusted to different distances from the passage gap 4.

The sheets B fed in from the conveying strands 17, 18 of the conveyor belts 19, 20 in the conveyor track 16 are raised into the horizontal plane 31 by the stacking ramp 13. The sheets B fed in from the conveying strands 17, 18 are conveyed past the sheets B already deposited on the paper guide 26, past the sheet B still being grasped by the suction roll 15, and can also be grasped by the suction roll 15.

The suction roll 15 is arranged such that its jacket surface 34 has a vertical distance "a" from the top side of the paper guide 26 or from the conveyor track 16 which should at most be equal to the vertical distance b of the vertical plane 31. However, it is most advantageous for the vertical distance "a" to be equal to or slightly smaller than the height h of the passage gap 4 and for the vertical distance b to be somewhat greater than the vertical distance "a".

The hollow suction roll 15 is provided with a plurality of suction holes 32 arranged in rows in the axial direction and distributed uniformly over the circumference. The hollow suction roll 15 is also provided on its inside with a suction air chamber 33, which is formed essentially by the hollow space of an essentially cylindrical suction housing 35, which is arranged concentrically to the suction roll 15 and has a plurality of vertically downwardly directed suction holes 36. These suction holes 36 are arranged at equal axial distances as the rows of suction holes 32 of the suction roll 15, so that the suction holes 32 of the rotating suction roll 15 come to temporarily coincide one after another with the suction holes 36 of the housing 35, which are directed vertically from the top radially toward the conveyor track 16 or the paper guide 26.

The suction air chamber 33 is in connection with a vacuum pump 40 via a suction air line 39. The intensity of the suction acting at the suction holes 36 and 32 can be regulated by means of a bypass valve 45 and can be optimally adjusted to the paper grade to be processed.

The suction roll 15 is driven continuously and synchronously with the folding rollers W1, W2, and W3.

Figure 6:
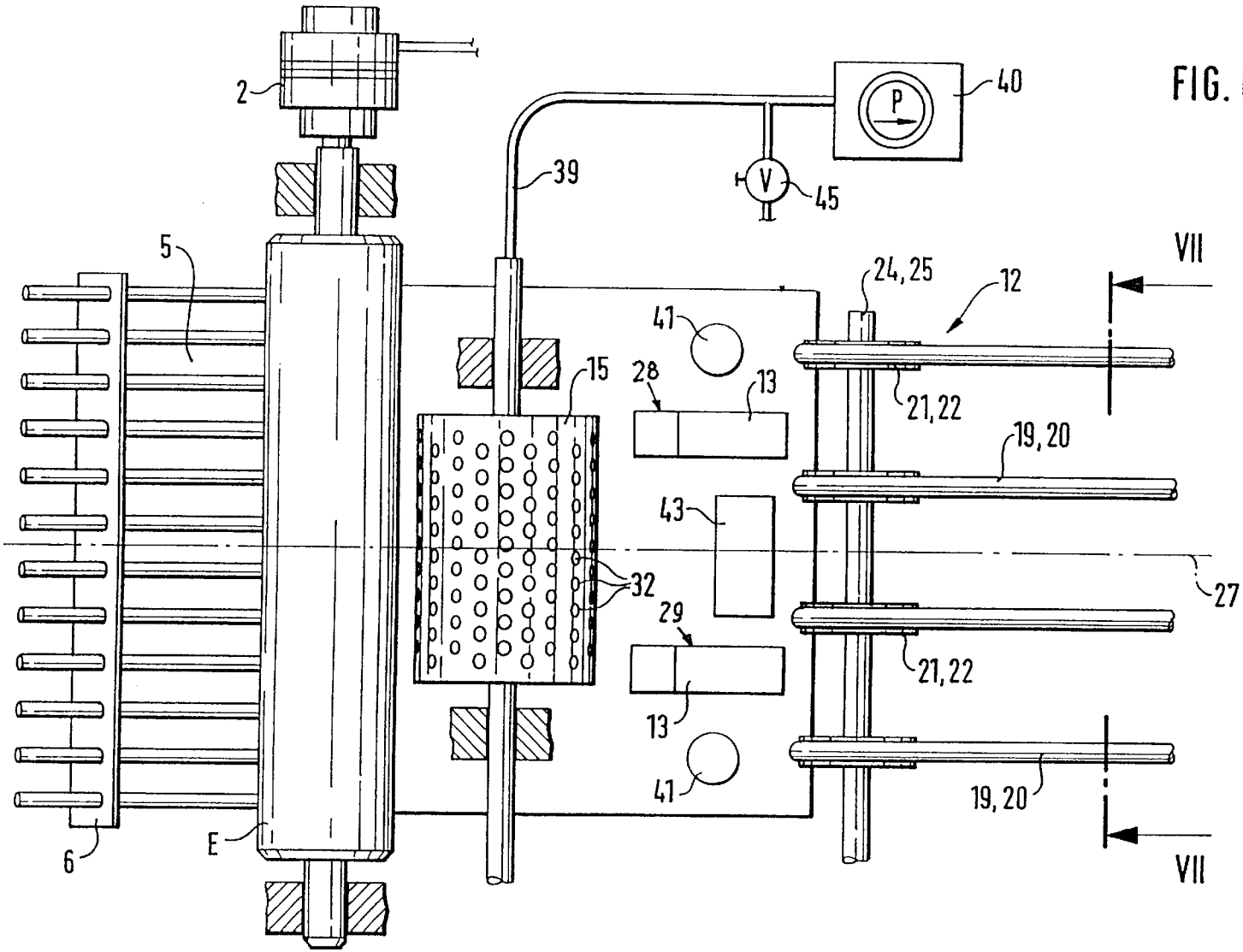
FIG. 6 is a schematic top view of the arrangement according to FIG. 1.
Figure 7:
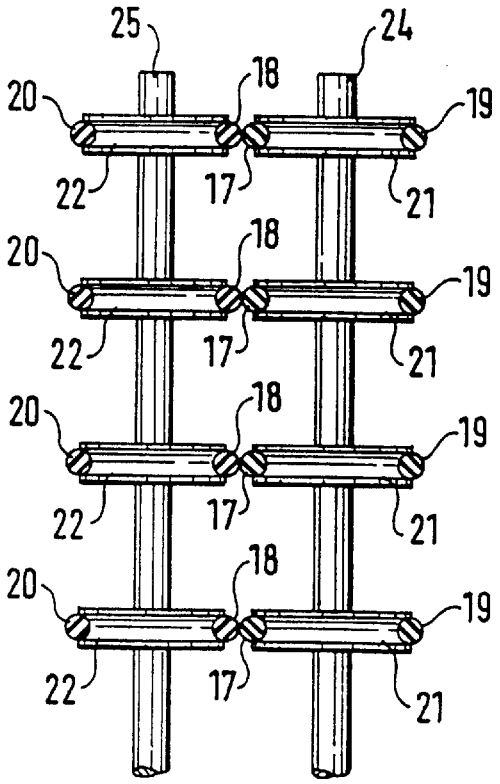
FIG. 7 is a section VII—VII from FIG. 5.

As is apparent from FIG. 6, the suction roll 15 has an axial length that is about half the axial length of the draw-in roller E or of the folding rollers W1, W2, W3, which are of equal length among themselves. The suction roller 15 is arranged in line with the axial center of the draw-in roller E or of the folding rollers W1, W2, W3, and symmetrically to the longitudinal central axis 27.

The conveying speed of the sheet feed means 12 is preferably equal to the circumferential speed of the uniformly rotating suction roll 15 and at most equal to the circumferential speed of the folding rollers W1, W2, W3.

When switched on, the electrically drivable one-stop clutch 2 connects the draw-in roller E or E1 to the drive (not shown) of the folding rollers W1, W2, W3.

To control the one-stop clutch 2, an electronic control unit 42 is provided (FIG. 5), to which two photoelectric cells 41 and/or a code reader 43 arranged in the area of the stacking ramp in the conveyor track 16 are connected. While the photoelectric cells 41 send one count signal to a counting device of the electronic control unit for each sheet of paper B passing through, the code reader 43 is intended to read control codes provided on the individual sheets of paper B fed in, and these control codes are processed in the electronic control unit such that they switch on the one-stop clutch 2 for one revolution. The same purpose is served by the count pulses sent by the photoelectric cells 41, which are sent to a presettable counter and generate the switch-on signal of the one-stop clutch 2 when the preset pulse count is reached.

During operation, individual sheets are first fed one after another from the sheet feed means 12 via the stacking ramp 13 such that they are grasped by the suction roll 15 and are introduced into the collecting folding pocket 5 to the paper stop 6 through the open passage gap 4 in a position in which they are lifted off from the conveyor track 16 or from the paper guide 26. It is ensured in the process that the newly arriving sheets of paper do not come into contact with the paper guide 26 or with the sheets of paper B already deposited thereon at least in the area located in front of the passage gap 4 in the direction of feed. The electrostatic charge, which is normally generated by the surface friction between the sheets of paper B is extensively avoided but at least reduced to a minimum as a result. The mode of operation, i.e., the trouble-free entry of the individual sheets of paper B into the collecting folding pocket 5, is not compromised. The next sheet pushes itself over the hanging-down end of the sheet that had already entered and it then separates itself from the suction roll 15, so that this can be deposited also with its rear section on the paper guide 26 or on the sheets B already present. The intensity of the suction actually set ensures that only one sheet B can be held by the suction roll 15 at any one time. It is thus possible to operate the suction roll 15 with a continuously acting, constant suction. Pulsed operation is not necessary.

It is possible due to the adjustability of the stacking ramp 13 within the conveyor track 16 to set its distance from the draw-in point EZ or from the paper stop 6 of the collecting folding pocket 5 corresponding to the actual sheet lengths and types of fold. It is thus possible to collect and fold together sheets of equal length and sheets of unequal length.

Figure 4:
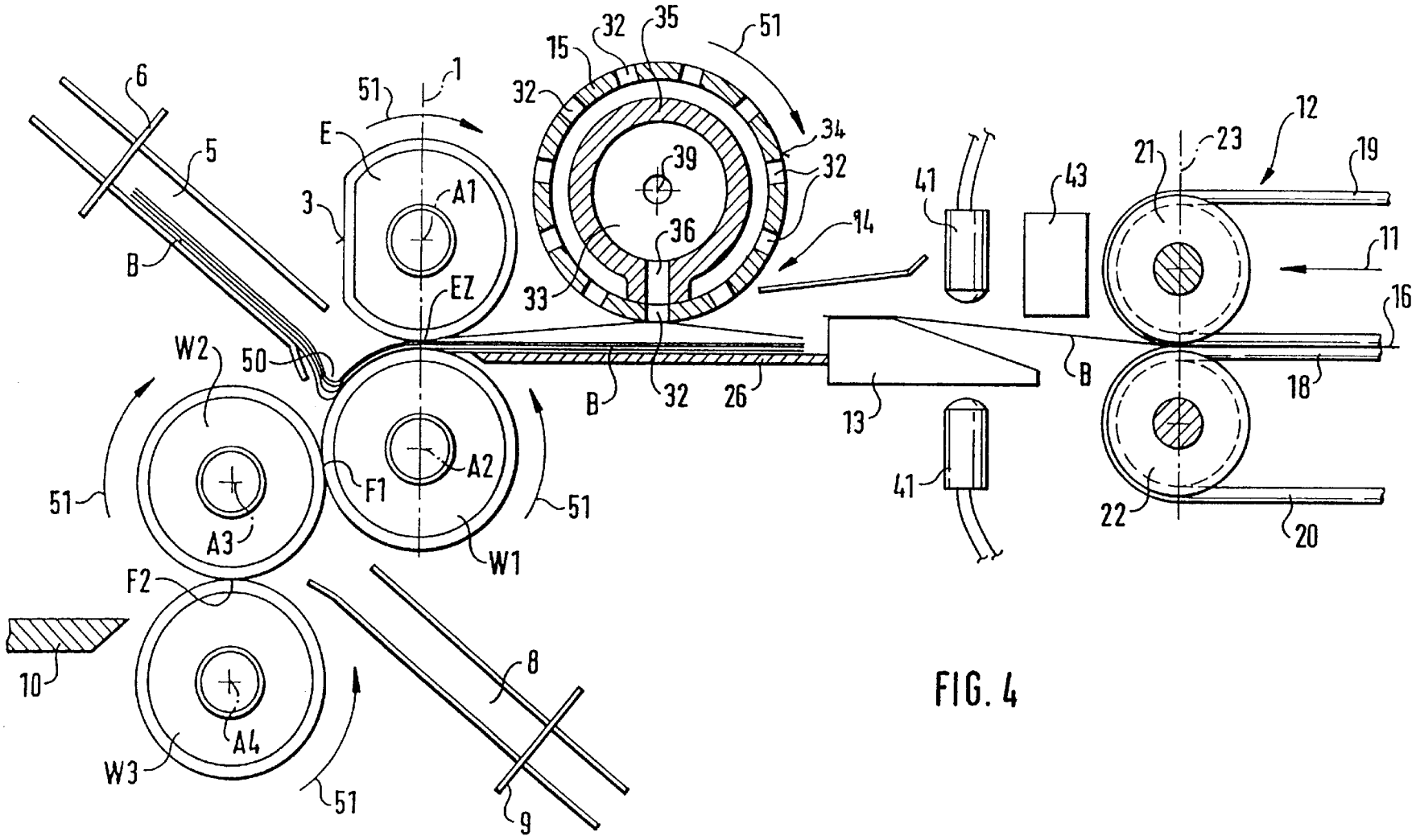
FIG. 4 is the same arrangement as FIG. 1, but in another functional position.

As soon as the predetermined number of sheets B have collected in the collecting folding pocket 5, i.e., as soon as that number of sheets has completely entered the collecting folding pocket 5, the one-stop clutch 2 receives a switch-on pulse for one revolution from the electronic control unit, so that the draw-in roller E or E1 performs one full revolution and it causes in the process the rear sections of the sheet which are still outside the draw-in point EZ or the passage gap 4 to be grasped and "drawn in" together, so that fold loops 50 are formed, as is shown in FIG. 4. These fold loops 50 are eventually folded in the folding point F1 and are subsequently sent in the usual manner either into the second folding pocket 8 and subsequently through the second folding point F2 to the outside, or past the second folding pocket 8 and directly into the second folding point F2.

Figure 8:
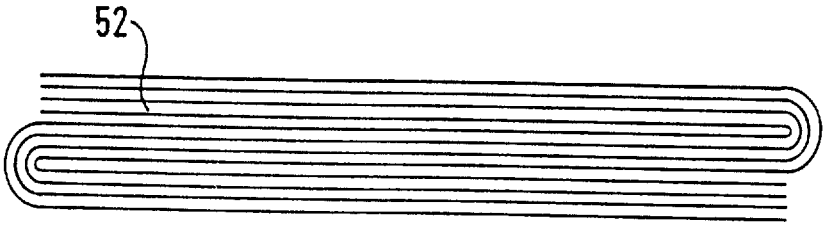
FIG. 8 schematically shows four sheets of paper folded in a zigzag pattern.

The end product schematically shown in FIG. 8, e.g., a stacks of sheets 52 of four sheets of paper, folded in a zigzag pattern, may thus be formed. The directions of rotation of the folding rollers W1, W2, W3, of the suction roll 15, and of the draw-in rollers E and E1 are indicated by arrows 51.

It should be additionally mentioned that it would also be possible to form the open passage gap 4 by a correspondingly eccentric mounting of a solid cylindrical draw-in roller 4.

While specific embodiments of the invention have been shown and described in detail to illustrate the application of the principles of the invention, it will be understood that the invention may be embodied otherwise without departing from such principles.

What is claimed is:

1. A buckle-chute folding machine comprising:

a folding mechanism including an upper draw-in roller and a lower draw-in roller forming a draw-in point defining an open passage gap, said folding mechanism also including at least one pair of folding rollers forming a folding point;

sheet feed means for delivering a predetermined plurality of sheets of paper toward said draw-in point of said folding mechanism, said sheet feed means including a conveyor track directed toward said draw-in point and positioned immediately upstream of said draw-in point;

a folding pocket with a paper stop positioned downstream of said draw-in point and equipped for collection and subsequent joint folding of the predetermined plurality of sheets of paper, a corresponding predetermined plurality of collected sheets pass together from said folding pocket through said folding point;

stacking ramp means for receiving the sheets from said sheet feed means and moving the sheets to a conveying position vertically spaced above said conveyor track and any sheets lying on said conveyor immediately downstream of said stacking ramp means;

additional sheet drive means for conveying a corresponding predetermined plurality of newly arriving sheets from said stacking ramp means in said conveying position from said stack ramp means through said draw-in point and into said folding pocket, said additional sheet drive means being positioned between said stacking ramp and said draw-in point in order to collect said predetermined plurality of sheets in said folding pocket and subsequently allow each of said predetermined plurality of sheets to be simultaneously folded by the buckle-chute folding mechanism.

2. A buckle-chute folding machine in accordance with claim 1, wherein:

said additional sheet drive means includes a rotatingly driven suction roll with suction directed toward said conveyor track.

3. A buckle-chute folding machine in accordance with claim 2, wherein:

said suction roll includes means for controlling an intensity of said suction.

4. A buckle-chute folding machine in accordance with claim 3, wherein:

said suction roll includes means for uniformly rotating said suction roll at a circumferential speed corresponding to a conveying speed of said sheet feed means and said circumferential speed is at most equal to a circumferential speed of said folding rollers.

5. A buckle-chute folding machine in accordance with claim 3, wherein:

said stacking ramp means includes means for positioning said stacking ramp at different distances from said draw-in point.

6. A buckle-chute folding machine in accordance with claim 2, wherein:

said suction roll includes a jacket surface, a distance "a" between said jacket surface and said conveyor track is at most equal to an amount said stacking ramp means projects over said conveyor track.

7. A buckle-chute folding machine in accordance with claim 2, wherein:

said suction roll includes means for uniformly rotating said suction roll at a circumferential speed corresponding to a conveying speed of said sheet feed means and said circumferential speed is at most equal to a circumferential speed of said folding rollers.

8. A buckle-chute folding machine in accordance with claim 2, wherein:

said stacking ramp means includes means for positioning said stacking ramp at different distances from said draw-in point.

9. A buckle-chute folding machine in accordance claim 2, wherein:

said upper draw-in roller forms said passage gap and is driven from a resting position for one revolution synchronously with the said folding rollers (W1, W2, W3) in terms of its circumferential speed by means of a remotely controllable one-stop clutch.

10. A buckle-chute folding machine in accordance with claim 9, wherein:

said passage gap of said draw-in point is formed by a circumferential section of said upper draw-ill rolled, said circumferential section being flattened in a segment-like manner.

11. A buckle-chute folding machine in accordance with claim 9, wherein:

said passage gap of said draw-in point is formed by a circumferential section of said upper draw-in roller, said circumferential section having a radius reduced by a width of said passage gap.

12. A buckle-chute folding machine in accordance claim 1, wherein:

said upper draw-in roller forms said passage gap and is driven from a resting position for one revolution synchronously with the said folding rollers (W1, W2, W3) in terms of its circumferential speed by means of a remotely controllable one-stop clutch.

13. A buckle-chute folding machine in accordance with claim 12, wherein:

said passage gap of said draw-in point is formed by a circumferential section of said upper draw-in roller, said circumferential section being flattened in a segment-like manner.

14. A buckle-chute folding machine in accordance with claim 12, wherein:

said passage gap of said draw-in point is formed by a circumferential section of said upper draw-in roller, said circumferential section having a radius reduced by a width of said passage gap.

15. A buckle-chute folding machine in accordance with claim 1, wherein:

said stacking ramp means includes means for positioning said stacking ramp at different distances from said draw-in point.

16. A buckle-chute folding machine in accordance claim 15, wherein:

said upper draw-in roller forms said passage gap and is driven from a resting position for one revolution synchronously with the said folding rollers (W1, W2, W3) in terms of its circumferential speed by means of a remotely controllable one-stop clutch.

17. A buckle-chute folding machine in accordance with claim 16, wherein:

said passage gap of said draw-in point is formed by a circumferential section of said upper draw-in roller, said circumferential section being flattened in a segment-like manner.

18. A buckle-chute folding machine in accordance with claim 16, wherein:

said passage gap of said draw-in point is formed by a circumferential section of said upper draw-in roller, said circumferential section having a radius reduced by a width of said passage gap.

19. A buckle-chute folding machine comprising:

a folding mechanism including an upper draw-in roller and a lower draw-in roller forming a draw-in point, said folding mechanism also including one pair of folding rollers forming a folding point;

sheet feed means for delivering a predetermined plurality of sheets toward said draw-in point of said folding mechanism, said sheet feed means including a draw-in paper guide directed toward said draw-in point and positioned immediately upstream of said draw-in point;

a folding pocket positioned downstream of said draw-in point for collection of the predetermined plurality of sheets for subsequent joint folding, and from which a corresponding predetermined plurality collected sheets pass together through said folding point, said folding pocket including a paper stop;

stacking ramp means for receiving the sheets from said sheet feed means and moving the sheets to a conveying position spaced from said draw-in paper guide and any sheets lying on said draw-in paper guide;

additional sheet drive means for conveying the predetermined plurality of sheets in said conveying position from said stack ramp means through said draw-in point and into said folding pocket in order to collect said predetermined plurality of sheets in said folding pocket and subsequently allow each of said predetermined plurality of sheets to be simultaneously folded by the buckle-chute folding mechanism.

20. A buckle-chute folding machine in accordance with claim 19, wherein:

said additional sheet drive means partially positions the sheets in said folding pocket.

* * * * *